US012791293B2

(12) United States Patent
Buchanan

(10) Patent No.: US 12,791,293 B2
(45) Date of Patent: Nov. 10, 2026

(54) ILLUMINATED DEVICE FOR PRE-CHARGED PNEUMATIC GUN PROJECTILES

(71) Applicant: CenterCross Archery LLC, Burnsville, NC (US)

(72) Inventor: Howard Andrew Buchanan, Burnsville, NC (US)

( * ) Notice: Subject to any disclaimer, the term of this patent is extended or adjusted under 35 U.S.C. 154(b) by 350 days.

(21) Appl. No.: 18/242,493

(22) Filed: Sep. 5, 2023

(65) Prior Publication Data

US 2024/0077290 A1 Mar. 7, 2024

Related U.S. Application Data

(60) Provisional application No. 63/469,538, filed on May 29, 2023, provisional application No. 63/403,537, filed on Sep. 2, 2022.

(51) Int. Cl.

| | |
|---|---|
| ***F42B 6/06*** | (2006.01) |
| ***F42B 6/10*** | (2006.01) |
| ***F42B 12/42*** | (2006.01) |

(52) U.S. Cl.

CPC ..... *F42B 6/06* (2013.01); *F42B 6/10* (2013.01); *F42B 12/42* (2013.01)

(58) Field of Classification Search

CPC ..... F42B 6/02; F42B 6/04; F42B 6/06; F42B 6/10; F42B 12/38; F42B 12/42; F41B 11/00; F41B 11/70; F41B 11/80; F41B 11/89

USPC ..... 473/570, 578; 124/56

See application file for complete search history.

(56) References Cited

U.S. PATENT DOCUMENTS

| | | | | |
|---|---|---|---|---|
| 4,340,930 | A * | 7/1982 | Carissimi | F42B 12/362 D22/115 |
| 4,890,597 | A * | 1/1990 | Ekstrom | F41B 11/83 124/71 |
| 5,058,900 | A * | 10/1991 | Denen | F21V 33/008 362/802 |
| 5,086,749 | A * | 2/1992 | Ekstrom | F41B 11/83 124/71 |
| 5,134,552 | A * | 7/1992 | Call | F21V 33/008 362/276 |
| 5,141,229 | A * | 8/1992 | Roundy | H01H 35/14 473/578 |
| 5,878,735 | A * | 3/1999 | Johnson | F41B 11/681 124/59 |
| 6,048,280 | A * | 4/2000 | Palmer | F41B 11/71 124/16 |
| 6,123,631 | A * | 9/2000 | Ginder | F42B 12/362 473/578 |
| 6,390,642 | B1 * | 5/2002 | Simonton | F42B 12/362 362/276 |
| 6,736,742 | B2 * | 5/2004 | Price | F42B 12/382 473/578 |

(Continued)

*Primary Examiner* — Alexander R Niconovich
(74) *Attorney, Agent, or Firm* — HSML P.C.

(57) ABSTRACT

A projectile for use with an air gun includes a light-emitting apparatus and a switch the controls the light-emitting apparatus. The switch is sensitive to pressure and causes the light-emitting apparatus to emit visible light in response to gas pressure that ejects the projectile from the air gun. The visible light assists a shooter in observing the flight path of the projectile and may assist the shooter in tracking a target animal by increasing the visibility of the projectile after it has impacted the target animal.

19 Claims, 7 Drawing Sheets

(56) References Cited

U.S. PATENT DOCUMENTS 7,021,784 B2 * 4/2006 DiCarlo ..... F21V 33/008 362/253
7,316,625 B2 * 1/2008 Takahashi ..... F42B 12/382 473/578
7,837,580 B2 * 11/2010 Huang ..... F42B 6/06 473/578
7,849,627 B2 * 12/2010 Wygant ..... F42B 12/34 124/63
7,900,619 B1 * 3/2011 Palmer ..... F42B 12/42 124/16
8,342,990 B1 * 1/2013 Price ..... F42B 12/362 473/570
8,540,594 B2 * 9/2013 Chu ..... F42B 6/06 473/570
8,758,177 B2 * 6/2014 Minica ..... F42B 6/06 473/570
8,944,944 B2 * 2/2015 Pedersen ..... F42B 12/42 473/578
9,140,527 B2 * 9/2015 Pedersen ..... F42B 6/02
9,151,580 B2 * 10/2015 Pedersen ..... F42B 6/02
9,546,851 B2 * 1/2017 Kim ..... F42B 12/382
9,568,290 B2 * 2/2017 Marshall, Jr. ..... F42B 12/36
9,677,859 B1 * 6/2017 Kim ..... F42B 6/06
9,702,672 B1 * 7/2017 Kim ..... F42B 6/06
9,897,423 B2 * 2/2018 Bay ..... F42B 12/382
9,989,231 B2 * 6/2018 Mai ..... F42B 12/382
10,001,353 B1 * 6/2018 Godsey ..... F42B 6/06
10,094,642 B1 * 10/2018 Godsey ..... F42B 6/06
10,139,205 B2 * 11/2018 Yehle ..... F42B 12/42
10,254,095 B1 * 4/2019 Wang ..... F21V 23/04
10,704,873 B1 * 7/2020 Minica ..... F42B 6/06
10,794,672 B2 * 10/2020 Oman ..... F21V 23/0414
10,859,353 B1 * 12/2020 Minica ..... F42B 6/06
10,921,103 B2 * 2/2021 Carlston ..... F42B 6/10
11,209,253 B2 * 12/2021 Birner ..... F42B 6/06
11,385,033 B2 * 7/2022 Langdon ..... F41B 5/12
11,598,614 B1 * 3/2023 Godsey ..... F42B 6/06
2005/0188979 A1 * 9/2005 Berry ..... F42B 14/064 124/76
2010/0285721 A1 * 11/2010 Ma ..... F42B 8/12 446/485
2015/0198407 A1 * 7/2015 Giannelli ..... F41B 11/62 124/76
2016/0290757 A1 * 10/2016 Khoshnood ..... F41B 5/123
2016/0334196 A1 * 11/2016 Carlston ..... F42B 6/10
2017/0234660 A1 * 8/2017 Carlston ..... F42B 6/02 124/56
2018/0058799 A1 * 3/2018 Kawawaki ..... F42B 12/42
2019/0265009 A1 * 8/2019 Harrington ..... F42B 6/06
2023/0160657 A1 * 5/2023 Hilt ..... F41B 11/642 124/67

* cited by examiner

ILLUMINATED DEVICE FOR PRE-CHARGED PNEUMATIC GUN PROJECTILES

CROSS-REFERENCE TO RELATED APPLICATIONS

This application claims the benefit of U.S. Provisional Patent Application No. 63/403,537, filed Sep. 2, 2022 and U.S. Provisional Patent Application No. 63/469,538, filed May 29, 2023, both of which are hereby incorporated by reference in their entireties.

TECHNICAL FIELD

This disclosure relates to pneumatic gun projectiles.

BACKGROUND OF THE INVENTION

Air guns include a reservoir or tank, a barrel, and a trigger mechanism. The reservoir or tank is configured to store and retain a gas, such as carbon dioxide or air, at a high pressure. The tank is in selective fluid communication with the barrel. The trigger mechanism is configured to control fluid communication between the tank and the barrel. More specifically, when the trigger mechanism is in the default state, the trigger mechanism prevents fluid communication between the tank and the barrel. When the trigger mechanism is in an activated state, the trigger mechanism enables fluid communication between the tank and the barrel, resulting in a rapid increase in pressure that propels a projectile out of the barrel.

Traditionally, archery arrows (or crossbow bolts) are launched with bows or crossbows having limbs that are elastically deformed to store kinetic energy. When the limbs are released, the energy is transferred to the arrow or bolt via a string to launch the arrow. More recently, various archery devices have been developed that employ compressed gas to store energy for launching arrows. These compressed-gas devices are often referred to as pre-charged pneumatic (PCP) air bows or arrow guns.

SUMMARY

Projectiles are provided herein for use with air guns or pre-charged pneumatic air bows. According to one embodiment, a projectile includes a body having a first end and a second end, an outer surface, and an inner surface that defines a chamber. A light assembly includes a light-emitting apparatus within the chamber of the body. The light-emitting apparatus is configured to selectively emit light. A switch member is movable relative to the body between a first position and a second position. The light assembly is configured such that the light-emitting apparatus does not emit light when the switch member is in the first position, and the light-emitting apparatus emits light when the switch member is in the second position.

The projectile is insertable into the barrel of an air gun such that, when the pressure inside the barrel increases to eject the projectile, the pressure also causes the switch member to move from the first position to the second position, thereby turning on the light-emitting apparatus, which emits visible light as the projectile is moving toward a target.

The projectile provided herein improves upon the prior art because the visible light assist a shooter to view the flight path of the projectile and where it impacts a target animal.

The visible light from the projectile may also aid in the tracking and retrieval of the animal if the animal moves after impact.

A corresponding method of using the projectile is also provided herein.

The above features and advantages and other features and advantages of the present disclosure are readily apparent from the following detailed description of the best modes for carrying out the disclosure when taken in connection with the accompanying drawings.

DETAILED DESCRIPTION

Figure 1:
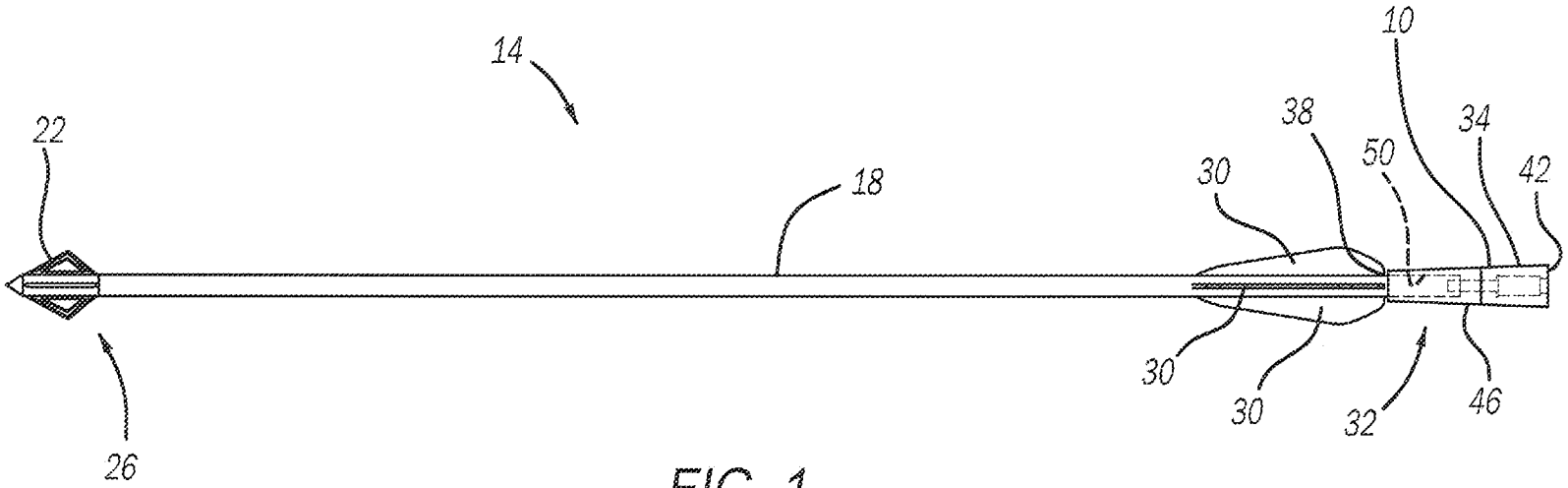
FIG. 1 is a schematic, side view of a projectile with a device in accordance with the claimed invention attached at one end.

Referring to the Figures, wherein like reference numbers refer to like components throughout, there is illustrated therein a new and improved lighted end device 10 for an elongated air gun projectile 14. Projectile 14 includes a cylindrical shaft 18, an arrowhead 22 mounted at a first end 26 of the shaft 18, and a plurality of vanes 30 attached to the shaft 18 adjacent a second end 32 of the shaft 18 and extending radially outward therefrom to form fletching, as understood by those skilled in the art.

The device 10 includes a housing, or body, 34. In the embodiment depicted, the body 34 comprises a translucent or transparent material such that light is transmissible therethrough, such as a clear polymer. The body 34 is substantially frusto-conical. More specifically, the body 34 has a first end 38 and a second end 42, and an exterior surface 46 between the first end 38 and the second end 42 that is frusto-conical such that the diameter of the body 34 increases with distance from the first end 38. Accordingly, the diameter of the body 34 is greatest at the second end 42.

The body 34 has a first cylindrical inner surface portion 48 that defines a first cylindrical chamber 50 and a circular opening 54 to the first cylindrical chamber 50 at the first end 38. The diameter of the chamber 50 and the opening 54 is slightly smaller than the diameter of the shaft 18 so that the end 32 of the shaft 30 is insertable into the chamber 50 via the opening 54 as best shown in FIG. 1. In the embodiment depicted, the diameter of the chamber 50 is marginally smaller than the shaft 18 such that, when the end 32 of the shaft 18 is press-fit into the chamber 50, the body 34 is secured to the shaft 18.

The body 34 also has a second cylindrical inner surface portion 56 that defines a second cylindrical chamber 58 that is in fluid communication with the second end 42 of the body 34. More specifically, the body 34 has a third inner surface portion 62 that defines a third cylindrical chamber 64 and a circular opening 66 to the third chamber 62 at the second end 42 of the body 34.

The third chamber 64 is contiguous with the second chamber 58, and thus the second chamber 58 is in fluid communication with the exterior of the body 34 at the second end 42 via the third chamber 64 and the opening 66. The diameter of the third chamber 64 is smaller than the diameter of the second chamber 58, and thus a radially-extending lip 70 is formed between the second inner surface portion 56 and the third inner surface portion 62.

The device 10 further includes a light assembly 74 that is configured to selectively emit light. More specifically, in the embodiment depicted, the light assembly 74 includes assembly includes a battery 78, a light-emitting apparatus such as a light-emitting diode (LED) 82, and a pressure-actuated switch 86. The switch 86 operatively interconnects the battery 78 and the LED 82 such that the switch 86 controls the flow of electricity from the battery 78 to the LED 82. More specifically, a circuit interconnects the battery 78, the LED 82, and the switch 86; the switch 86 closes the circuit in response to gas pressure.

Figure 2:
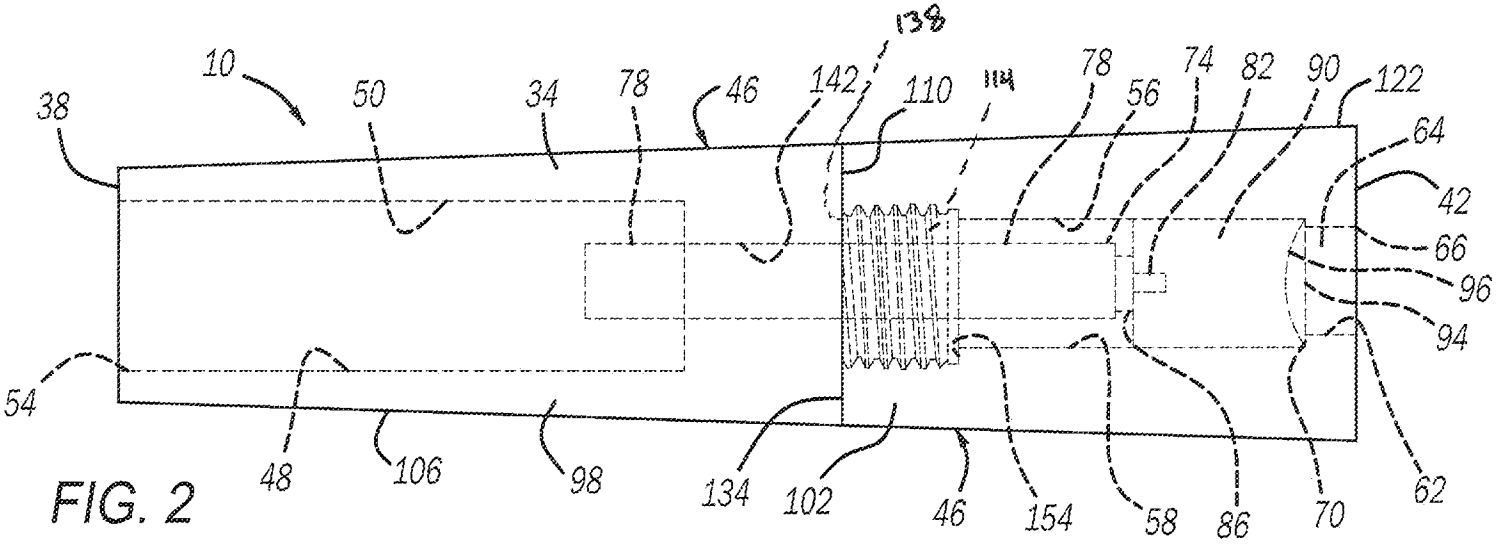
FIG. 2 is a schematic, side view of the device of FIG. 1 with a lighting assembly having a switch member in a first position.
Figure 3:
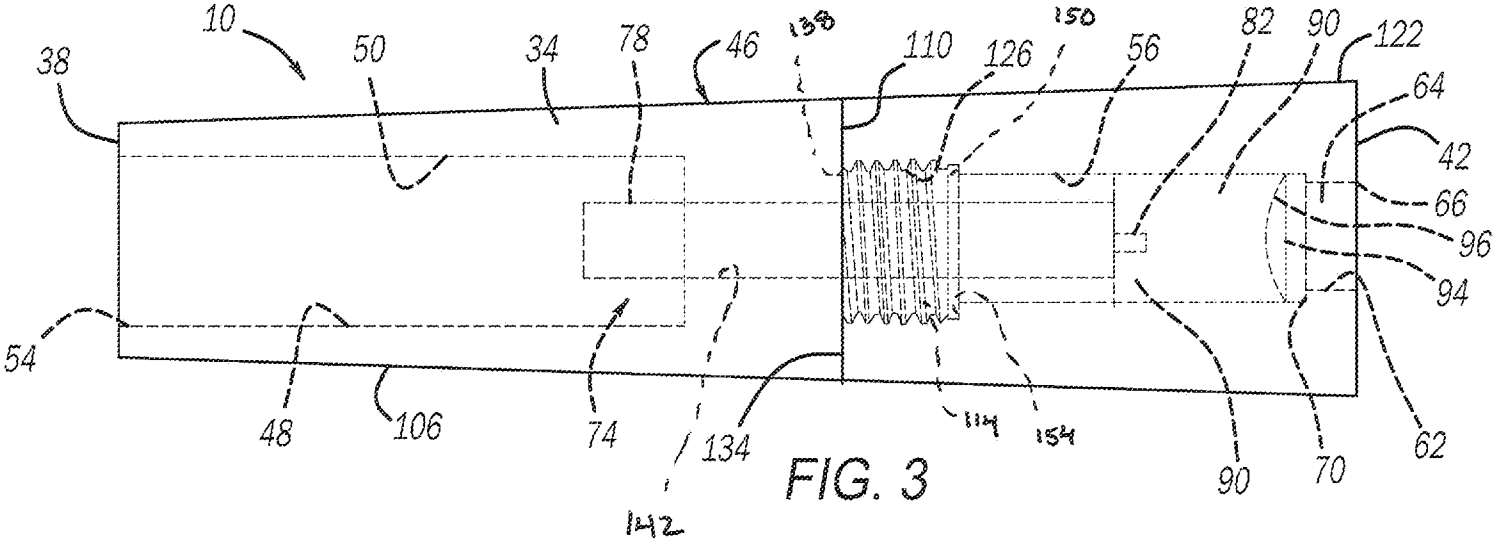
FIG. 3 is a schematic, side view of the device of FIG. 1 with the switch member in a second position.
Figure 4:
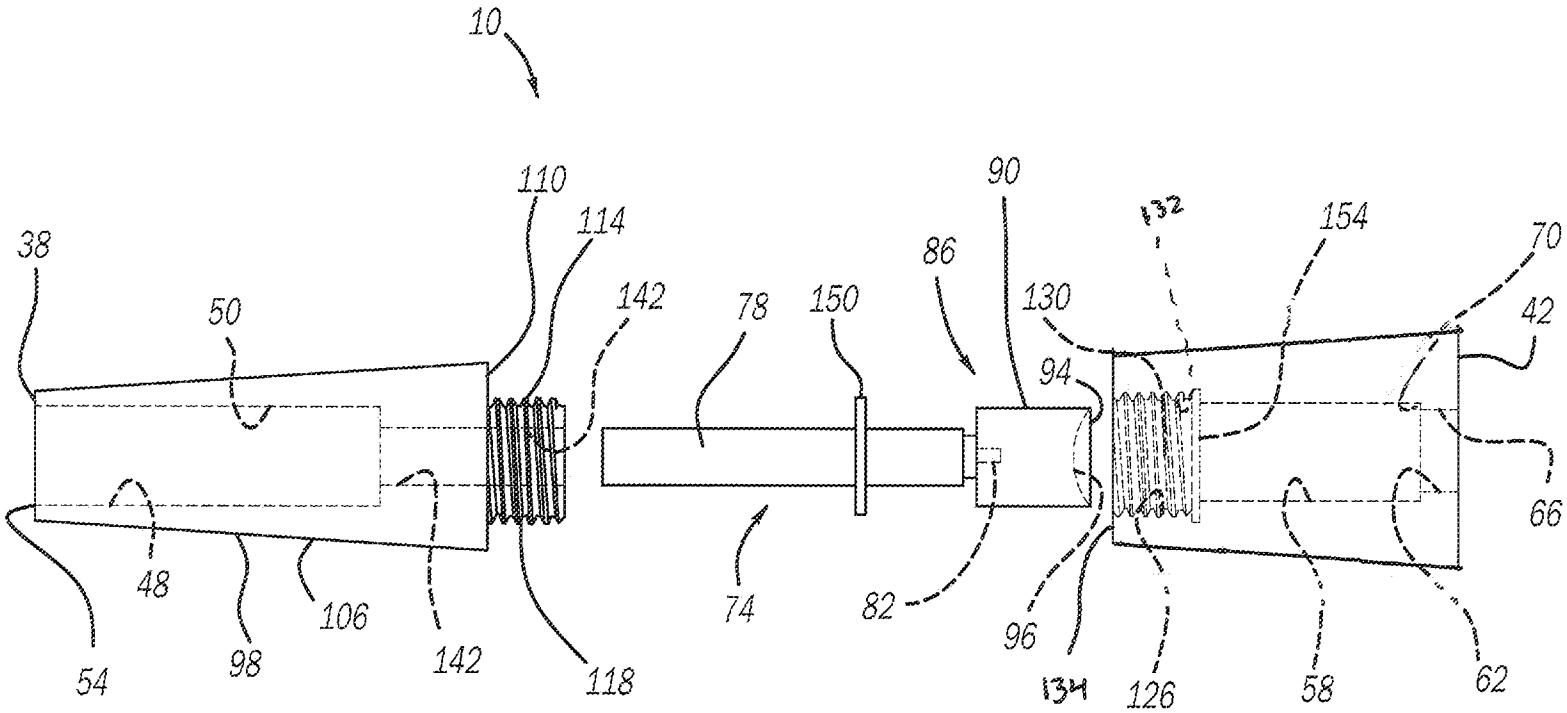
FIG. 4 is a schematic, partially exploded, side view of the device.
Figure 5:
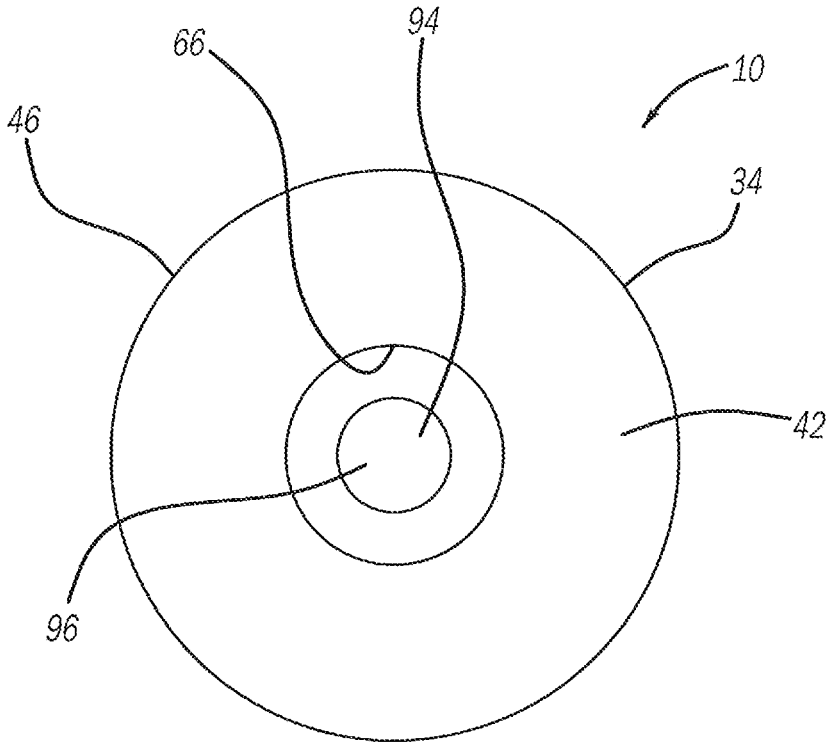
FIG. 5 is a schematic, end view of the device.

The switch 86 includes a switch member 90 that is movable relative to the body 34 and the battery 78 between a first position, as shown in FIG. 2, and a second position, as shown in FIG. 3. When the switch member 90 is in the first position relative to the body 34 and the battery 78, the switch 86 is open and the LED 82 does not emit light. When the switch member 90 is in the second position, the circuit is closed and the LED 82 emits light.

When the switch member is in the first position, surface 94 of the switch member 90 abuts the lip 70. In the second position, surface 94 is away from the lip 70 and the switch member 90 is further from the opening 66 than in the first position. In the embodiment depicted, the switch member 90 is a transparent or translucent polymeric cover member that covers the LED 82. The switch member 90 is substantially cylindrical and is disposed within the second chamber 58. The outer diameter of the switch member 90 is marginally less than the diameter of the second chamber 58, and thus the second inner surface portion 56 restricts the movement of the switch member 90 relative to the body 34 to linear translation and, potentially, rotation about the centerline of the chamber 58.

Thus, the switch member 90 in the embodiment depicted functions as a piston or plunger, i.e., sufficient air pressure acting on surface 94 of the switch member 90 will cause the switch member 90 to move from the first position to the second position. Accordingly, the light assembly 74 is configured to turn on and emit light in response to sufficient fluid pressure at the second end 42, because surface 94 is in fluid communication with end 42. Surface 94 defines a concavity 96.

In the embodiment depicted, the body 34 comprises a first piece 98 and a second piece 102 that are interconnected. The first piece 98 defines end 38, inner surface 48, and a segment 106 of the outer surface 46. Piece 98 defines a flat surface 110 having a protuberance 114 extending therefrom. Protuberance 114 has external helical threads 118. The second piece 102 defines another segment 122 of the outer surface 46, inner surfaces 58, 62, and end 42. Piece 102 defines an inner surface 126 defining chamber 130. Inner surface 126 defines helical internal threads 132. Piece 102 also defines a flat surface 134 having an opening 138 to the chamber 130.

The threaded protuberance 114 is insertable into the chamber 130 via the opening 138, and threads 118 are engageable with threads 132 as shown in FIGS. 2 and 3 so that the pieces 98, 102 are connected to one another with surface 110 abutting surface 134 and the segments 106, 122 cooperating with each other to define the frusto-conical outer surface 46.

Piece 98 defines another chamber 142 sized to fit the end of the battery 78. The chamber 142 extends from the chamber 50 through the protuberance 114. Chamber 130 is contiguous with chamber 58, and in the embodiment depicted, the battery 78 is retained within chambers 50, 142, 130, and 58. Battery 78 is fitted around its middle with a retaining clip 150, which is captured between a lip 154 and the protuberance 114. Lip 154 is formed between surfaces 56 and 126.

The device 10 provides a rigid construction requiring little maintenance, modular and connectable housing allowing for tool-free access to internal components, improved aerodynamics and accuracy of the conical-shaped housing as well as reduced chanced for being snagged as the projectile passes entirely through a target, the ability to trace a high-velocity shot travel and point of impact in many environment lighting conditions.

Figure 6:
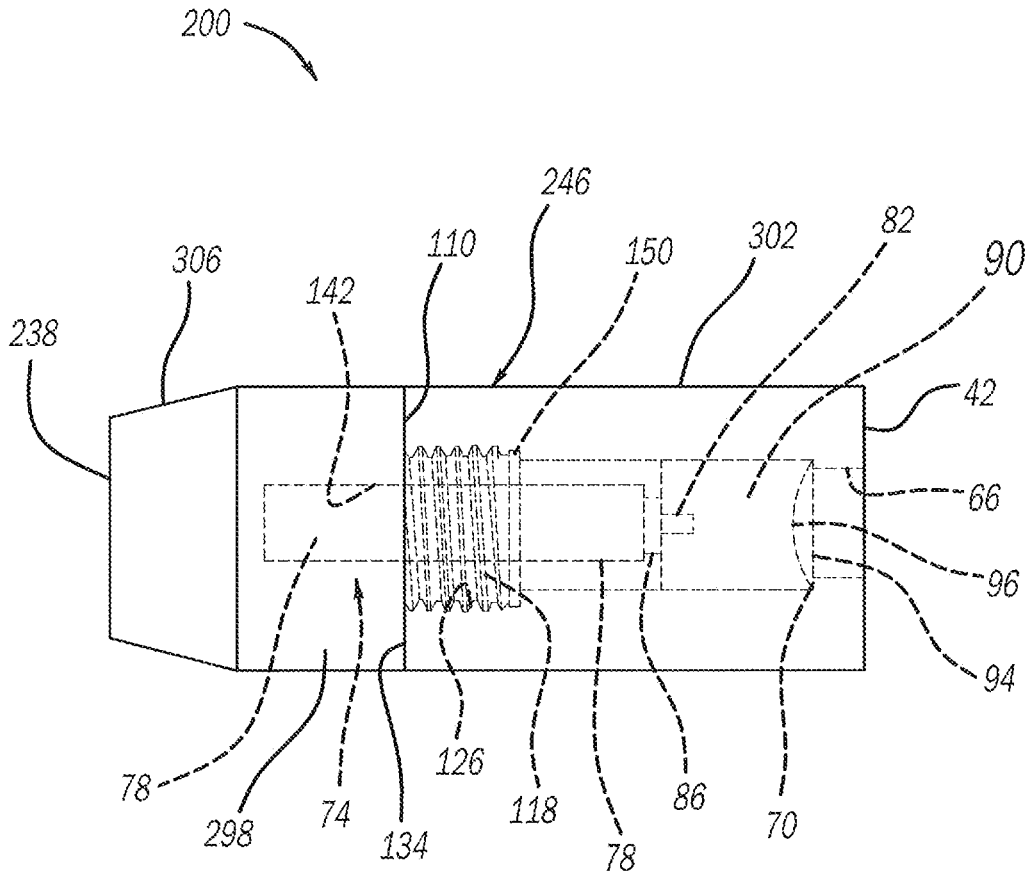
FIG. 6 is a schematic, side view of a sabot slug having a pressure-activated light.
Figure 7:
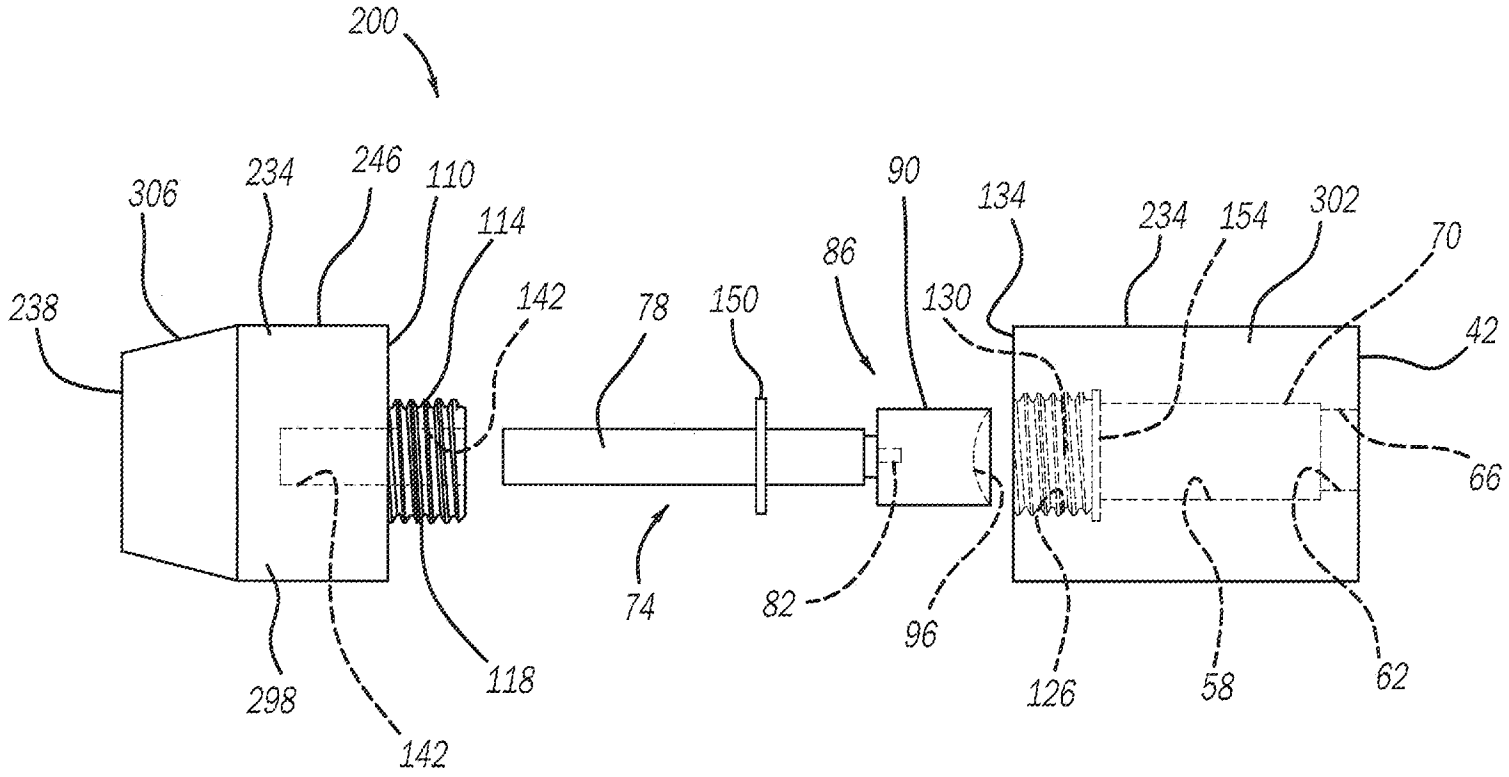
FIG. 7 is a schematic, partially exploded, side view of the sabot slug of FIG. 6.

FIGS. 6 and 7, wherein like reference numbers refer to like components from FIGS. 1-5, schematically depict a projectile 200 for use with a pre-charged pneumatic air gun. Referring to FIGS. 6 and 7, the projectile 200 is substantially identical to the device shown at 10 in FIGS. 1-5, except that the exterior surface 246 is substantially cylindrical instead of frusto-conical, end 238 is closed instead of forming the opening 54 and chamber 50 shown in FIGS. 1-5.

More specifically, the projectile 200 includes two pieces 298, 302 that are substantially identical to pieces 98, 102 except as explained below. The exterior surface of piece 302 is cylindrical. The exterior surface of piece 298 is cylindrical except for a tapered section 306 near end 238. Piece 298 is characterized by the absence of chamber 50 and opening 54. Furthermore, pieces 298 and 302 are formed of an opaque metal instead of a translucent polymer. Light from the LED 82 will be emitted through opening 66.

Accordingly, projectile 200 forms a slug, and more specifically a sabot slug, having the light assembly 74 that is activated by pressure acting on switch member 90 via the opening 66.

Figure 8:
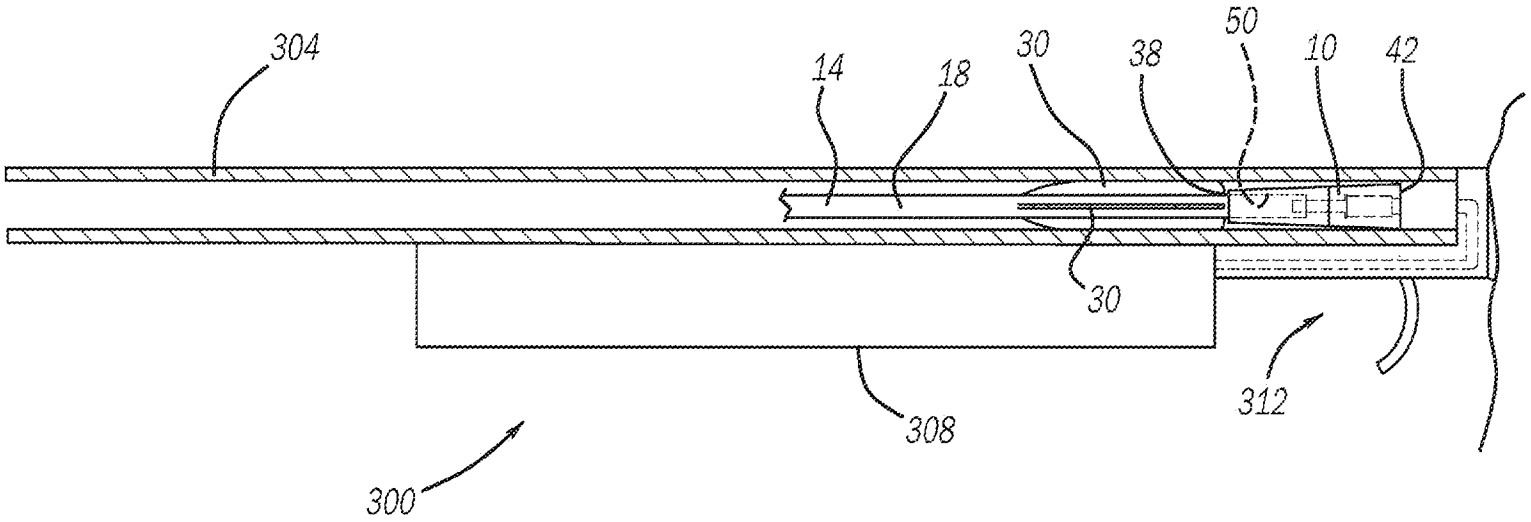
FIG. 8 is a schematic, sectional side view of the projectile of FIG. 1 in the barrel of an air gun.

A method of using the projectile 14 or projectile 200 is schematically depicted in FIG. 8. Referring to FIG. 8, an air gun 300 includes a barrel 304 a tank 308 containing a compressed gas (a gas at a pressure significantly above atmospheric pressure). The air gun 300 also includes a trigger mechanism 312 that controls fluid communication between the tank 308 and the barrel 304. When the trigger mechanism 312 is in its default state, there is no fluid communication between the tank 308 and the barrel 304. When the trigger mechanism 312 is activated by a user, the trigger mechanism 312 provides fluid communication between the tank 308 and the breech of the barrel 304 for a period of time, thereby increasing the pressure inside the barrel 304.

Those skilled in the art will recognize a variety of air guns with which the projectiles 14, 200 of the present disclosure may be used, including, but not limited to, the SENECA® Wing Shot .50 caliber air shotgun, the UMAREX® .50 caliber Hammer air rifle, and the AIRFORCE® .50 caliber Texan air rifle.

The method may include inserting the end 32 of the shaft 18 into the first chamber 50 via the opening 54 such that the device 10 is operatively connected to the projectile 14 as shown in FIG. 1. The switch member 90 is in the first position, and thus the LED 82 is not emitting light. The method also includes inserting the projectile 14, including the device 10 attached to the shaft 14, into the barrel of the pneumatic gun 300 or "air bow," with the device 10 being inserted first such that the end 42 is exposed to the source of compressed gas at the breech. The vanes 30 may be collapsed or deformed during insertion into the barrel 304. The diameter of the outer surface 46 at the end 42 will be only marginally smaller than the inner diameter of the barrel 304.

The method further includes causing the end 42 to be subjected to gas pressure from the tank 308, i.e., by activating the trigger mechanism 312. The gas pressure causes the switch member 90 to move from the first position to the second position, thereby causing the LED 82 to emit light. The gas pressure also causes the projectile 14 with the device 10 to be forcefully ejected from the barrel 304.

While the best modes for carrying out the disclosure have been described in detail, those familiar with the art to which this disclosure relates will recognize various alternative designs and embodiments for practicing the disclosure within the scope of the appended claims.

The invention claimed is:

1. A projectile for use with an air gun or air bow having a barrel, a tank storing compressed gas, and a trigger mechanism that controls fluid communication between the barrel and the tank, the projectile comprising:

a body having a first end and a second end, an outer surface, and an inner surface that defines a chamber; and a light assembly having a light-emitting apparatus within the chamber that is configured to selectively emit light, and a switch member that is movable relative to the body between first and second positions, the switch member is a gas pressure actuated switch configured to be moved relative to the body by sufficient gas pressure at the second end of the body, said light assembly being configured such that the light-emitting apparatus does not emit light when the switch member is in the first position, and the light-emitting apparatus emits light when the switch member is in the second position;

wherein the projectile is insertable into the barrel such that, when the trigger mechanism permits fluid communication between the tank and the barrel, gas pressure pushes on the switch member to move from the first position to the second position and the projectile to be ejected from the barrel.

2. The projectile of claim 1, wherein the switch member is in fluid communication with the second end of the body, such that gas at the sufficient gas pressure at the second end of the body flows and pushes the switch member from the first position to the second position.

3. The projectile of claim 2, wherein the body forms a sabot slug.

4. The projectile of claim 2, wherein the body defines a bore open at the first end; and wherein the projectile further comprises a shaft extending into the bore and an arrowhead mounted to the shaft.

5. The projectile of claim 4, further comprising:

vanes mounted to, and extending radially from, the shaft to form fletching.

6. The projectile of claim 4, wherein the body is transparent or translucent.

7. The projectile of claim 6, wherein the body is frustoconical; and wherein a diameter of the body at the first end is smaller than a diameter of the body at the second end.

8. The projectile of claim 1, wherein the switch member is a piston configured to be moved relative to the body by the sufficient gas pressure.

9. The projectile of claim 1, wherein the switch member is configured to move from the first position to the second position while the projectile is within the barrel of the air gun or air bow.

10. A method for use with an air gun or air bow having a barrel, a tank storing compressed gas, and a trigger mechanism that controls fluid communication between the barrel and the tank, the method comprising:

possessing a projectile assembly having a body and a light assembly; said body having a first end and a second end, an outer surface, and an inner surface that defines a chamber, said light assembly having a light-emitting apparatus within the chamber that is configured to selectively emit light, and a switch member that is movable relative to the body between first and second positions, wherein the switch member is a gas pressure actuated switch configured to be moved relative to the body by sufficient gas pressure at the second end of the body, the light assembly is configured such that the light assembly does not emit light when the switch member is in the first position, and the light assembly emits light when the switch member is in the second position;

inserting the projectile assembly into the barrel with the switch member in the first position;

increasing gas pressure within the barrel such that the gas pressure causes the switch member to move from the first position to the second position.

11. The method of claim 10, wherein said increasing pressure within the barrel causes the projectile to move out of the barrel.

12. The method of claim 11, wherein said increasing gas pressure within the barrel includes activating the trigger mechanism thereby to cause fluid communication between the barrel and the tank.

13. The method of claim 10, wherein said switch member is in fluid communication with the second end of the body, such that gas of the increasing gas pressure in the barrel at the second end of the body flows and pushes against the switch member.

14. The method of claim 13, wherein the body forms a sabot slug.

15. The method of claim 13, wherein the body defines a bore open at the first end; and wherein the projectile assembly includes a shaft extending into the bore and an arrowhead mounted to the shaft.

16. The method of claim 15, wherein the projectile assembly further includes vanes mounted to, and extending radially from, the shaft to form fletching.

17. A projectile comprising:

a body having a first end, a second end, a first bore and a second bore having a common centerline;

wherein the first bore has a first opening at the first end;

wherein the second bore has a second opening at the second end;

wherein a shaft of an arrow or crossbow bolt is insertable within the first bore through the first opening to secure the shaft to the body;

a light assembly configured to selectively emit light and including a pressure-activated switch having a switch member that is movable relative to the body between first and second positions;

wherein the light assembly is configured such that the light assembly does not emit light when the switch member is in the first position, and the light assembly emits light when the switch member is in the second position;

wherein the switch member is a gas pressure actuated switch positioned within the second bore such that sufficient gas pressure at the second opening causes the switch member to move from the first position to the second position.

18. The projectile of claim 17, wherein the body is transparent or translucent.

19. The projectile of claim 17, wherein the switch member is a piston within the second bore and is translatable in first and second directions.

* * * * *